US006494151B1

(12) United States Patent
Wark

(10) Patent No.: US 6,494,151 B1
(45) Date of Patent: Dec. 17, 2002

(54) EXHAUSTER DIFFUSER DISCHARGE VALVE

(75) Inventor: Rickey E. Wark, The Woodlands, TX (US)

(73) Assignee: Sure Alloy Steel Corporation

( * ) Notice: Subject to any disclaimer, the term of this patent is extended or adjusted under 35 U.S.C. 154(b) by 0 days.

(21) Appl. No.: 09/557,136

(22) Filed: Apr. 25, 2000

(51) Int. Cl.[7] ..... F23J 3/00

(52) U.S. Cl. ..... 110/129; 110/162; 406/86; 406/100

(58) Field of Search ..... 406/86, 96, 97, 406/98, 99, 100, 101, 102, 103, 104, 129; 110/162

(56) References Cited

U.S. PATENT DOCUMENTS 1,533,898 A * 4/1925 Prat ..... 406/96
4,256,044 A * 3/1981 Burton ..... 110/104 R
5,593,131 A * 1/1997 Briggs et al. ..... 251/117
5,685,240 A * 11/1997 Briggs et al. ..... 110/104 B
6,055,914 A * 5/2000 Wark ..... 110/101 R

* cited by examiner

*Primary Examiner*—Christopher P. Ellis
*Assistant Examiner*—Joe Dillon, Jr.
(74) *Attorney, Agent, or Firm*—Young & Basile

(57) ABSTRACT

A discharge valve plate of the type used in the conduit between an exhauster fan and a riffle box in a coal fine delivery system for a coal-fired combustion chamber in a power plant. The axis of rotation of the discharge valve plate is oriented generally perpendicular to the axis of rotation of the exhauster fan, such that the valve plate bisects the flow of coal fines from the exhauster fan into upper and lower flows, each having heavy and light distributions across the width of the conduit. The discharge valve plate is provided with diffuser elements engaging the upper and lower flows to cause the heavy and light flow distributions to mix prior to reaching the riffle box.

18 Claims, 5 Drawing Sheets

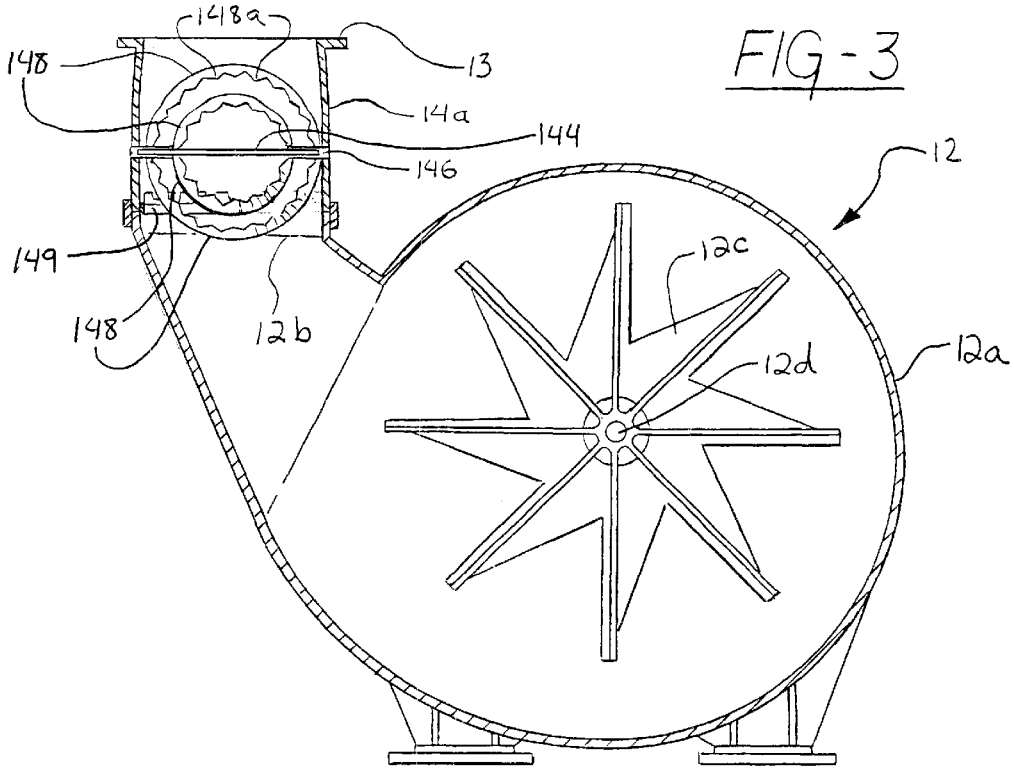
FIG-3
FIG-5
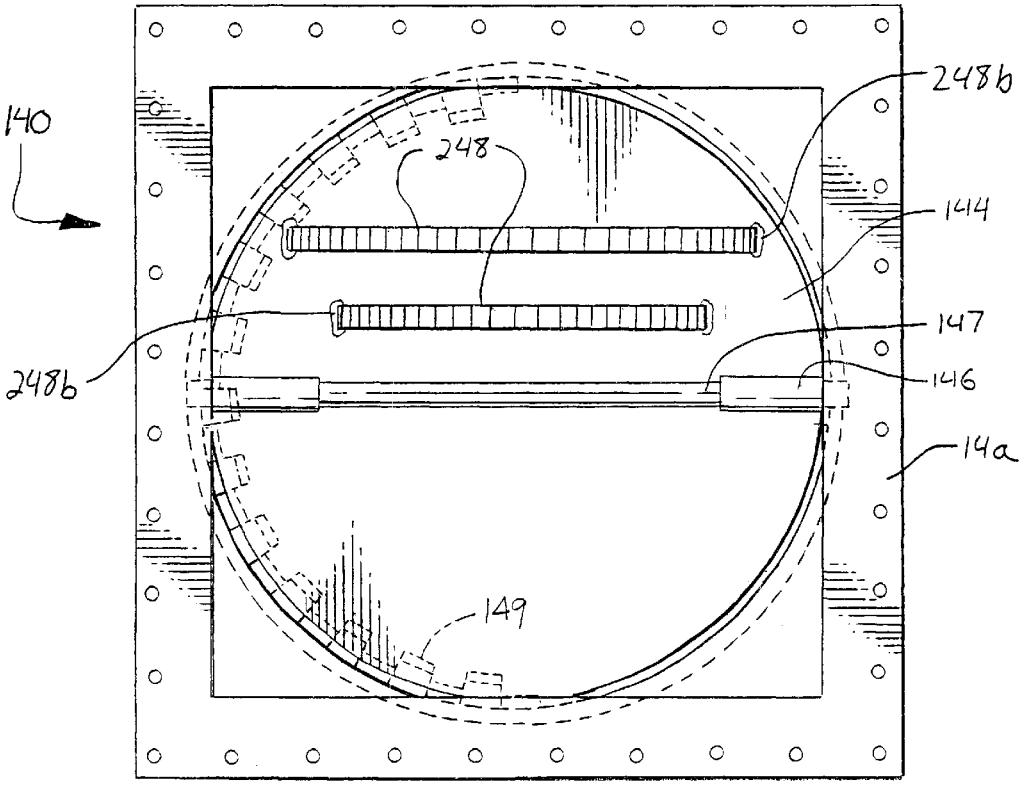

EXHAUSTER DIFFUSER DISCHARGE VALVE

FIELD OF THE INVENTION

The present invention relates to discharge or barrier valves in the delivery chute of a coal-fired power facility between the exhauster fan and riffle box.

BACKGROUND OF THE INVENTION

Coal-fired power generating facilities commonly use a combustion chamber fed with dustlike coal fines by multiple burner nozzles spaced uniformly around the chamber. It is critical to balance the flow from the burner nozzles to the fireball in the combustion chamber. Imbalances in this flow can result in NOX formation, erosion of boiler tubes in the combustion chamber, and LOI (loss on ignition) contamination of the saleable ash by-product.

The burner nozzles are fed with coal fines by a series of branched delivery chutes which typically emanate from a single source such as an exhauster fan. The exhauster fan provides suction and air flow necessary to pull coal fines from a mill or pulverizer and send them through the branched delivery pipes to the burner nozzles in the combustion chamber.

The centrifugal nature of the exhauster fan typically results in a separation of the coal fines into light and heavy flow distributions as they leave the fan. Each branching of the delivery pipe typically includes a "riffle box" of alternately angled diverters or plates whose function is to evenly redirect the flow of coal fines into the two branches. The uneven heavy/light distribution of fines leaving the exhauster fan, however, defeats the purpose of the riffle boxes.

The problem of heavy/light flow distributions of coal fines between the exhauster fan and the first riffle box is further exacerbated by the typical barrier valve plate in the delivery pipe between the exhauster fan and riffle box. The plane of the valve plate bisects the chute in a manner physically dividing the heavy and light distributions.

SUMMARY OF THE INVENTION

The present invention solves the problem of heavy/light distributions of coal fines between the exhauster fan outlet and the first riffle box in the delivery chute by (1) reorienting the valve plate axis at right angles to the axis of the exhauster fan, thereby splitting the coal flow in the pipe into identical "upper" and "lower" halves, each of which has a heavy/light distribution across the diameter of the pipe; and (2) providing the reoriented valve plate with diffuser elements on top and bottom surfaces thereof to radially redirect the heavy and light distributions in the top and bottom flows to merge and mix into a uniformly distributed flow upon reaching the riffle box.

In a preferred form the diffuser elements comprise an array of differently-sized semicircular diffuser elements on top and bottom surfaces of the valve plate.

In another aspect of the invention, an initial "kicker" diffuser element is located on the heavy distribution side of the entrance to the valve, preferably forming a peripheral semicircle on the heavy distribution side.

In yet a further aspect of the invention, peripheral diffuser elements are secured directly to the inside circumference of the portion of the chute which defines the valve plate housing, located to engage the edge circumference of the valve plate in the valve closed position to define one or more mechanical stops around the edge of the valve plate and further giving a sealing effect around the edge of the valve plate in the closed position.

These and other features and advantages of the invention will become apparent upon further reading of the specification, in light of the accompanying drawings.

BRIEF DESCRIPTION OF THE DRAWINGS

FIG. 3 illustrates the valve plate of FIG. 2 in the valve closed position.

FIG. 5 is a view of a valve plate similar to that in FIG. 4, but illustrating an alternate set of diffuser elements on the valve plate.

DETAILED DESCRIPTION OF THE ILLUSTRATED EMBODIMENTS

Figure 1:
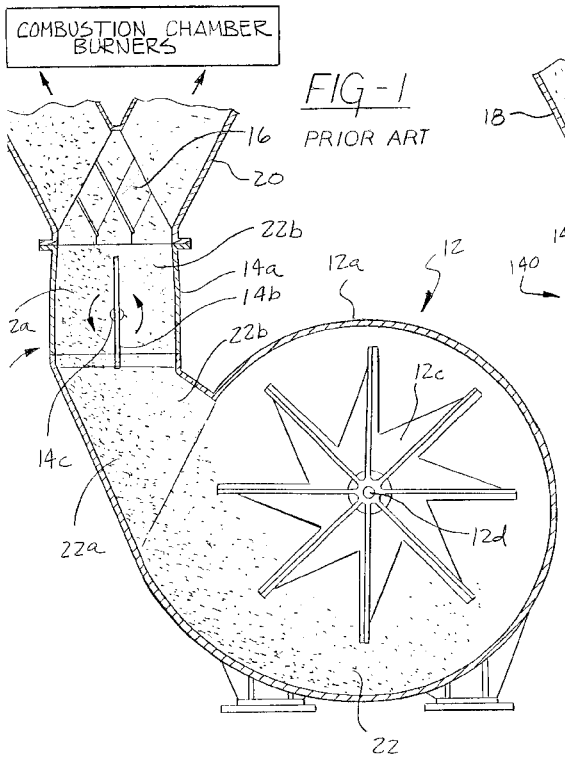
FIG-1 PRIOR ART
FIG. 1 illustrates a prior art valve plate between an exhauster fan and riffle box.

Referring first to FIG. 1, a prior art discharge valve assembly 14 is installed between an exhauster fan 12 of known type and a riffle box 16 of a known type at the junction of the branched pipes 18, 20 leading to a coal-fired combustion chamber of known type. The discharge valve assembly 14 is contained in a housing 14*a* comprising a delivery pipe-like conduit between exhauster outlet 12*b* and riffle box 16. Housing 14 in fact preferably comprises standard piping or conduit of the type use din branches 18, 20. A valve plate 14*b* is rotatably mounted on an axis of rotation 14*c* extending cross-wise through housing 14*a*, and is capable of being rotated between the valve open position shown in FIG. 1 to a valve closed position in the direction of the associated arrows. The valve plate 14*b* is typically a circular steel plate which substantially blocks all flow through housing 14*a* when closed.

Rotation of valve plate 14*b* about axis 14*c* can be effected by any known means, including manual levers or arms, electric or hydraulic motors, and other actuating mechanisms which are generally known to those skilled in the art.

Still referring to FIG. 1, the fan blades 12*c* of exhauster fan 12 throw pulverized coal "fines" 22 received from a pulverizer or similar mill structure (not shown) in a centrifugal flow out through outlet 12*b* to the riffle box 16 and pipes 18, 20. The radial nature of fan 12*c* rotating on axis 12*d* results in a centrifugal separation of heavier fines 22*a* from lighter fines 22*b* as they exit the exhauster fan. By the time the fines reach discharge valve assembly 14, they have separated themselves into heavy and light distributions which valve plate 14*b* tends to maintain and exacerbate, acting as a physical divider down the middle of the housing to keep heavy flow 22*a* separated from lighter flow 22*b* until they reach riffle box 16. Riffle box 16 is generally unable to remix the heavy and light distributions with the result that the volume of coal fed to pipes 18 and 20 is uneven. This results in burner imbalances in the combustion chamber which create the above-noted problems of NOX formation, LOI particles in the ash by-product, and boiler tube erosion and damage.

Valve plate 14*b* remains in the illustrated open position during normal exhauster operation, and is typically closed only occasionally for isolating the exhauster fan from the path to the combustion chamber, for example, during fan maintenance. Valve plate 14*b* is preferably formed from an abrasion-resistant steel as mentioned earlier, although other suitable materials and surfaces can be used in or applied to the valve plate, as will be understood by those skilled in the art.

Figure 2:
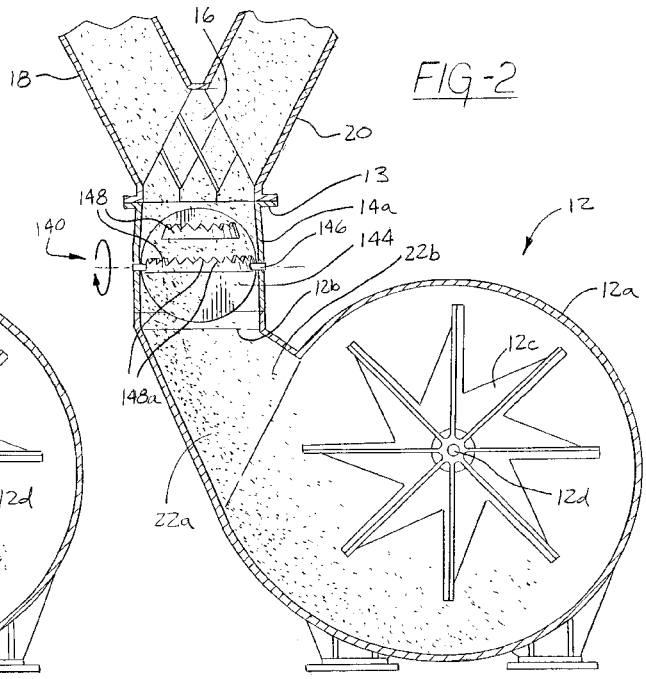
FIG. 2 illustrates the exhausted system of FIG. 1 with an exhauster discharge valve plate according to the present invention, replacing the valve plate in FIG. 1.

Referring next to FIG. 2, a first embodiment of the present invention is illustrated generally as valve assembly 140, contained in housing 14*a* and comprising a circular valve plate 144 having an axis of rotation 146 generally perpendicular to the axis 12*d* of exhauster fan 12, rather than generally parallel as in the prior art arrangement of FIG. 1. The orientation of valve plate 144 in FIG. 2 can be achieved by rotating housing 14*a* and/or valve plate 14*b* of FIG. 1; or valve assembly 140 can be created by replacing valve plate 14*b* with reoriented valve plate 144 in the old housing 14*a*; or an entirely new assembly 140 can replace assembly 14 from FIG. 1

The orientation of valve plate 144 in FIG. 2 splits the heavy and light flow distributions 22*a*, 22*b* into "upper" and "lower" (relative to the open valve plate) flows each having heavy and light components distributed across the width of the valve plate as illustrated. Accordingly, valve plate 144 no longer separates the heavy and light flow distribution created by the centrifugal flow from fan 12.

This reorientation of valve plate 144 is accompanied by the addition of static diffuser elements 148 on the upper and lower surfaces of valve plate 144. Referring to both FIGS. 2 and 3, diffuser elements 148 are illustrated as semi-circular toothed elements mounted on the upper and lower surfaces of valve plate 144 in coplanar fashion so as to define (when viewed from the perspective of coal flow through the housing) successive upstream/downstream rings of differing diameter with inwardly-directed rows of teeth positioned to engage components of both the heavy and light flow distributions 22*a* and 22*b*.

In the illustrated embodiment of FIGS. 2 and 3, diffuser elements 148 exhibit an inwardly angled, conical arrangement of triangular teeth 148*a* which serve to redirect the heavy and light flow distributions radially inwardly so that they converge and mix or implode over a relatively short distance of travel, prior to their reaching the entrance to riffle box 16. The angle of teeth 148*a* and the diameters of the diffuser elements 148 and their upstream/downstream spacing on valve plate 144 are factors which must be weighed by those skilled in the art for a given set of flow parameters and distribution problems, and for other known factors such as the distance between valve plate 144 and riffle box 16. In the illustrated embodiment the mixing or imploding action achieved by diffuser elements 148 is preferably achieved over a distance corresponding to about the radius of valve plate 144.

The open position of valve plate 144 in FIG. 2 clearly shows the mixing action of diffuser elements 148 on the heavy and light flow distributions 22*a*, 22*b*. In FIG. 3 the valve plate 144 has been rotated to the closed position blocking communication between the riffle box side of the system and the exhauster fan side of the system, for the purpose of performing repairs or maintenance on the exhauster fan in keeping with industry safety practices.

FIG. 3 illustrates an optional "kicker" element 149 comprising a toothed diffuser element of a generally semi-cylindrical configuration secured to the inside wall of housing 14*a* at or near the junction of housing 14*a* with exhauster outlet 12*b*. Kicker element 149 generally exhibits the inwardly-angled, conical arrangement of teeth found in diffuser elements 148, and serves to "kick" or redirect at least a portion of the heavy flow distribution 22*a* radially inwardly to ensure its contact with diffuser elements 148 on valve plate 144.

Figure 4:
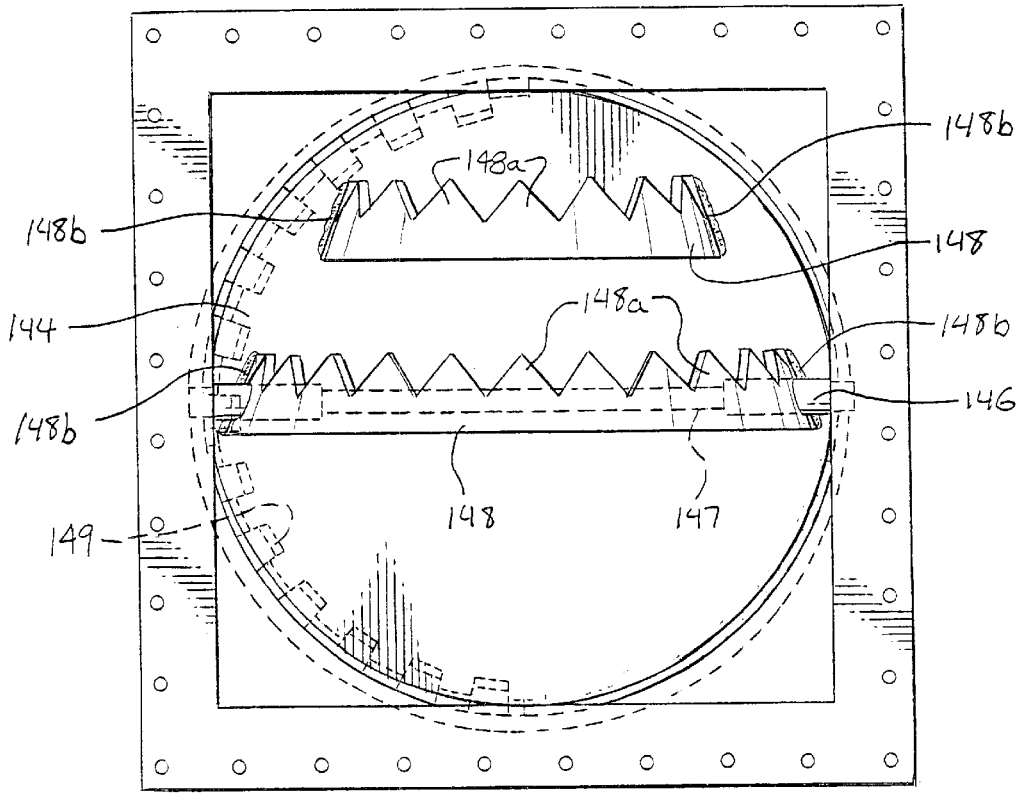
FIG. 4 is an end view of a valve plate according to the invention, looking through the conduit or housing leading to the valve plate from the perspective of the exhauster outlet, and illustrating the valve plate of FIGS. 2 and 3 in a valve closed position blocking the housing or conduit.
Figure 7:
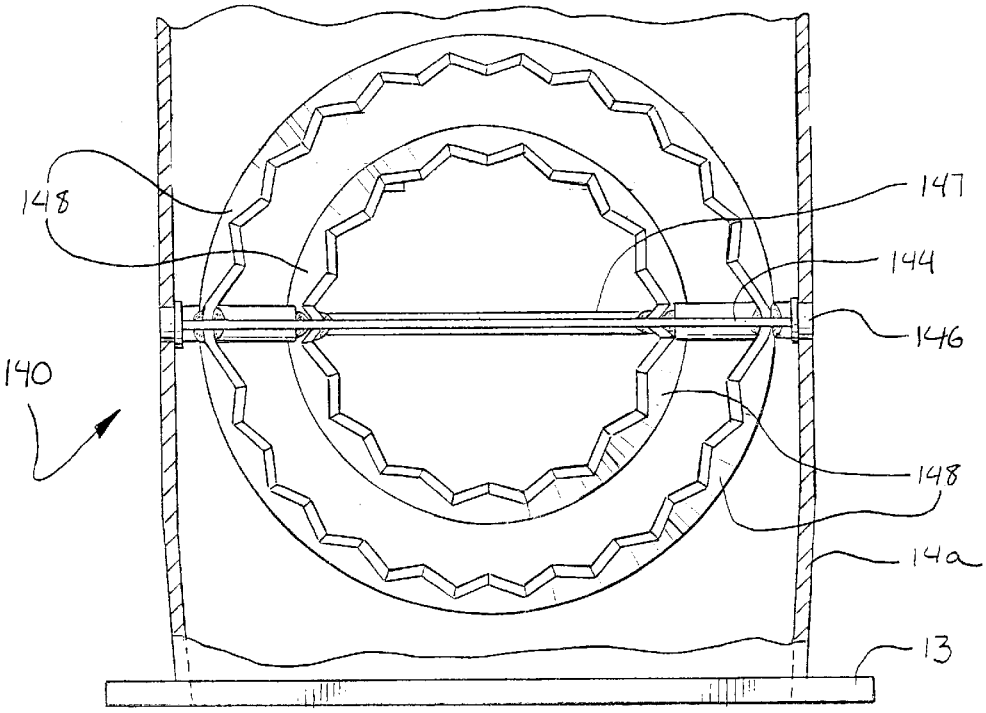
FIG. 7 is a view similar to that of FIG. 6, but illustrating a set of diffuser elements like those in FIGS. 2–4.

The diffuser discharge valve assembly 140 of FIGS. 2 and 3 is illustrated in greater detail in FIGS. 4 and 7. Valve plate 144 is mounted for rotation in housing 14*a* in known fashion, for example on bushings or bearings 146 rotatably supporting a shaft 147 secured to the plate to define an axis of rotation. Diffuser elements 148 as illustrated are formed from single pieces of suitably wear-resistant steel welded directly to valve plate 144 at their ends 148*b*. It will be understood from FIG. 3 that if FIG. 4 represents the "bottom" surface of valve plate 144, an equal array of diffuser elements 148 is formed on the opposite or "top" surface of the valve plate so that each element 148 forms one-half of a complete diffuser ring when viewed from the edge of the valve plate.

FIG. 4 helps illustrate the value of the staggered, differently sized elements 148 in preventing unwanted pressure build-up in the housing. While the upstream/downstream spacing of the diffuser elements 148 and their relative radii will be a matter of sizing to the job for those skilled in the art, in general the number of diffuser elements 148 on the valve plate and their relative radii is selected so as to minimize hindrance to the flow of coal fines through the housing and over the valve plate, and thereby minimize pressure drop affecting the overall performance of the coal feed to the combustion chamber.

Figure 6:
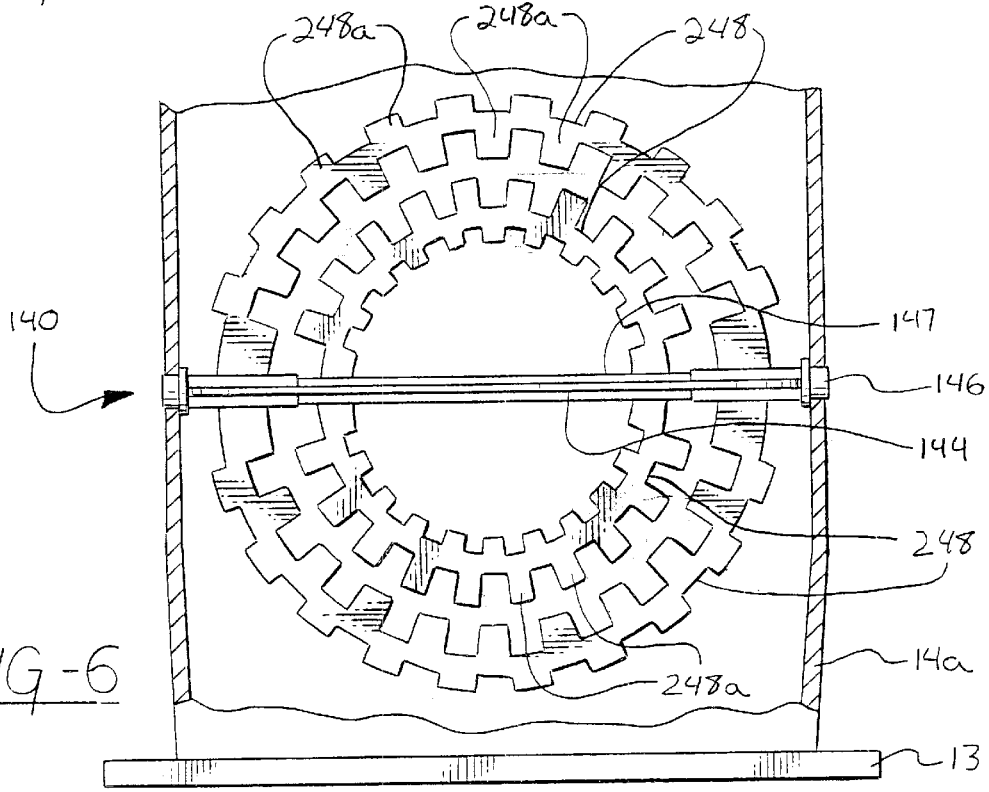
FIG. 6 is a detailed top view of the closed valve plate of FIG. 5.

Referring next to FIGS. 5 and 6, an alternate diffuser element structure is illustrated in diffuser elements 248, which comprise semi-circular rings of flat teeth or flow-disrupting projections 248*a* presenting perpendicular flow-disrupting surfaces to the flow of coal fines through the housing. These flat diffuser elements 248 more quickly disrupt and mix the coal fines than do the inwardly-angled elements 148 in FIGS. 2–4, but have a greater tendency to cause pressure drop across the valve plate. This tendency is compensated by different spacing of elements 248, or by the placement of fewer elements and/or elements of greater variance in radius on valve plate 144. Pressure drop can also be minimized by staggering or off-setting adjacent teeth 248*a* from the smaller "inner" and larger "outer" diffuser elements as shown in FIG. 6.

FIG. 6 also illustrates the use of diffuser elements with teeth pointing both radially inwardly toward the plate surface and extending radially outwardly away from the plate surface. These latter outward teeth or projections 248*a* provide more flow-disrupting surface area to engage and mix portions of the heavy/light flow distributions located radially outwardly of the circumference of the rings.

Flat diffuser elements 248, like their conical counterparts 148, are each preferably formed from a single piece of wear-resistant steel or other known material capable of withstanding the abrasive coal flow, and are welded or otherwise secured to the surface of valve plate 144 at their ends 248*b*.

While the illustrated embodiments of FIGS. 2–4 and FIGS. 5–6 illustrate diffuser elements located only on the downstream half of valve plate 144, it is also possible to place diffuser elements only on the upstream half, or to place them on both the downstream and upstream halves, depending on the nature of the flow problems encountered in a particular installation. Also, it can be seen by comparing FIGS. 4 and 5 that a larger-radius diffuser element may be placed either upstream or downstream of a smaller-radius diffuser element.

Figure 8:
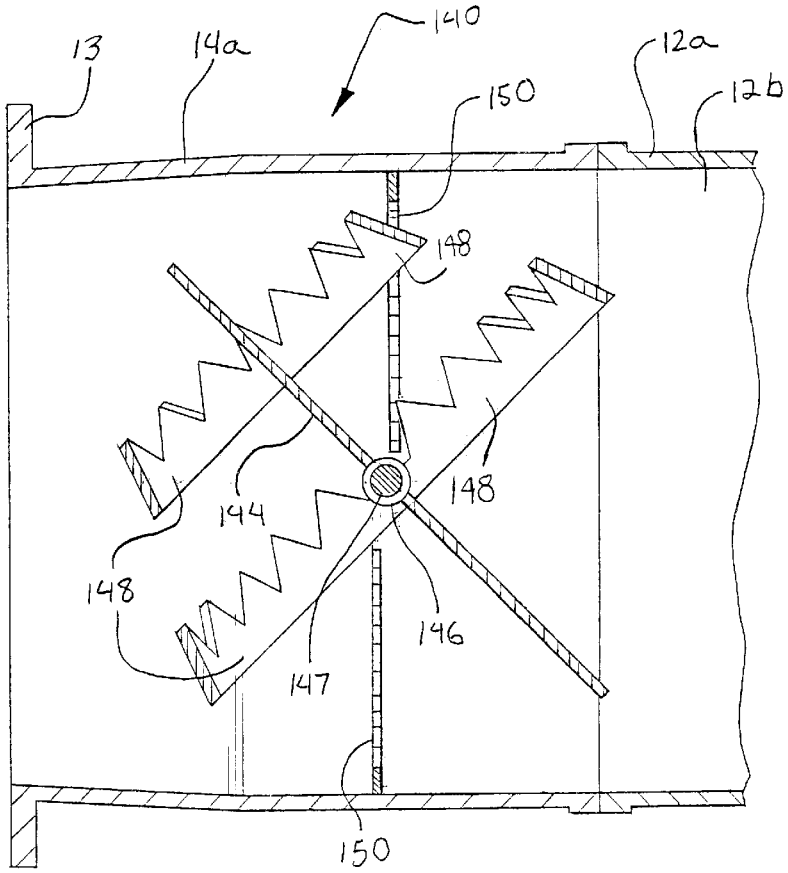
FIG. 8 is a side elevational view of the valve plate of FIG. 7, in section, viewing the valve plate from its rotational axis in a partially open condition to illustrate a set of peripheral stops located on the inside wall of the valve housing adjacent opposite sides of the valve plate.
Figure 9:
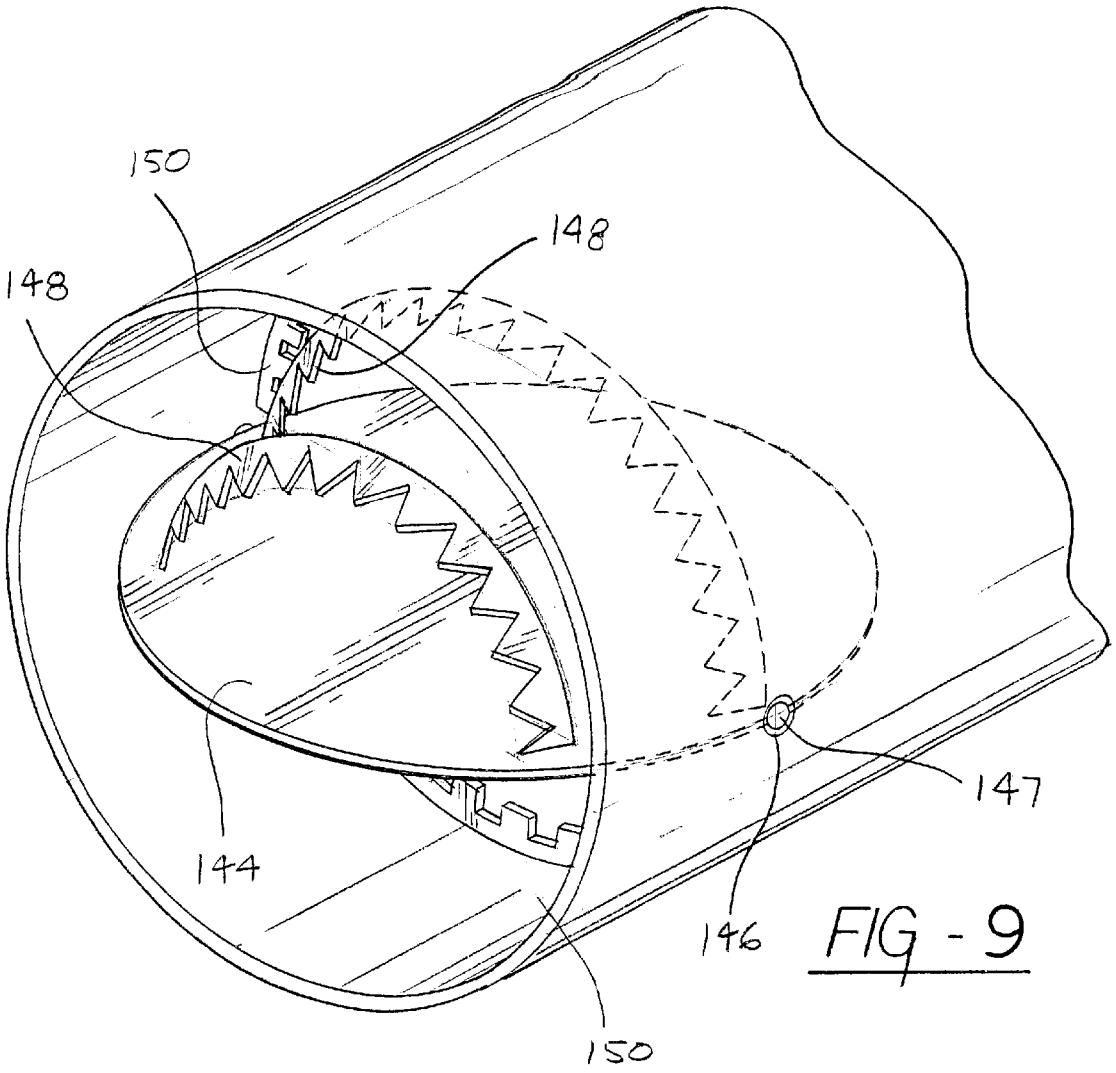
FIG. 9 is a perspective view from the discharge end of the valve plate and housing of FIG. 8, with the valve in a fully open position.

Referring next to FIGS. 8 and 9, the diffuser discharge valve assembly 140 according to FIGS. 2–4 is illustrated with the addition of peripheral stops 150 secured to the inner wall of housing 14*a* and engaging respective peripheral portions of the top and bottom surfaces of valve plate 144. In the illustrated embodiment of FIGS. 8 and 9, stops 150 are in the form of semicircular flat diffuser elements secured by welding or similar methods to housing 14*a* and engaging a semi-circular portion of the periphery of each side of the valve plate 144. While it is not necessary that stops 150 perform diffusing functions, their location on the periphery of the passage through 14*a* makes it advantageous to form diffuser teeth or projections in them to disrupt and mix radially outermost portions of the heavy and light flow distributions passing through the housing.

In addition to providing a positive stop to valve plate 144 in the closed position, and to diffusing the radially outermost portions of the heavy and light flow distributions, stops 150 can also provide a sealing function when machined carefully so as to further enhance the sealing effect of valve plate 144 in the valve closed position.

The foregoing description of several exemplary embodiments of the invention is not intended to limit the invention to those particular embodiments, as many modifications will be apparent to those skilled in the art now that I have disclosed my invention. For example, as noted above, the number, size, and spacing of diffuser elements on a particular valve plate installation will vary depending on the particular application. The valve plate need not be circular. And while two preferred forms of diffuser elements are illustrated, shapes and patterns of diffuser elements other than the preferred semi-circular and symmetrically-toothed forms illustrated are considered within the scope of the invention.

I accordingly claim:

1. In the conduit between an exhauster fan and a riffle box in a coal fine delivery system, the exhauster fan having a first axis of rotation tending to throw coal fines from the exhauster fan in uneven heavy and light flow distributions through the conduit, a discharge valve plate in the conduit rotatable between an open position and a closed position blocking the conduit, the improvement comprising the orientation of the valve plate on a second axis of rotation generally perpendicular to the first axis of rotation such that the flow of coal through the conduit is divided into an upper flow having heavy and light flow distributions above the valve plate and a lower flow having heavy and light distributions below the valve plate.

2. The discharge valve plate of claim 1, wherein the conduit includes a stop element secured to an inner wall of the conduit so as to engage a peripheral portion of the discharge valve plate in the closed position.

3. The discharge valve plate of claim 2, wherein the conduit includes a first stop element positioned to engage a bottom surface of the valve plate in the valve closed position, and a second stop positioned to engage a top surface of the valve plate in the valve closed position.

4. The discharge valve plate of claim 2, wherein the stop element includes a plurality of flow-disrupting projections extending radially into the conduit into the flow of coal fines over the valve plate.

5. The discharge valve plate of claim 1, wherein the valve plate includes a diffuser element extending from a surface thereof and positioned laterally across the flow of coal fines over the surface of the valve plate in the open position.

6. The discharge valve plate of claim 5, wherein the valve plate includes an upper diffuser element extending from the top surface of the valve plate and a lower diffuser element extending from the bottom surface of the valve plate.

7. The discharge valve plate of claim 6, wherein the upper and lower diffuser elements are symmetrically arranged.

8. The discharge valve plate of claim 7, wherein the upper and lower diffuser elements comprise semi-circular elements arranged in coplanar fashion.

9. The discharge valve plate of claim 5, wherein the valve plate includes a plurality of diffuser elements extending from a surface thereof.

10. The discharge valve plate of claim 9, wherein the diffuser elements are spaced from one another in a downstream direction.

11. The discharge valve plate of claim 10, wherein the spaced diffuser elements are offset from one another so as to engage different portions of the flow across the valve plate.

12. The discharge valve plate of claim 11, wherein the diffuser elements comprise semicircular elements extending generally perpendicularly from the valve plate, with two or more of the semi-circular elements having different radii.

13. The discharge valve plate of claim 5, wherein the diffuser element has portions positioned in both the heavy and light flow distributions across the valve plate.

14. The discharge valve plate of claim 13, wherein the diffuser element comprises a semicircular element extending generally perpendicularly from the valve plate.

15. The discharge valve plate of claim 14, wherein the diffuser element comprises a generally flat-faced element.

16. The discharge valve plate of claim 14,wherein the diffuser element comprises a semicircular element having a conical deflector surface extending radially inwardly and in a downstream direction.

17. The discharge valve plate of claim 14, wherein the diffuser element comprises a plurality of flow-disrupting projections extending radially from the ring into the flow of coal fines past the ring.

18. In the conduit between an exhauster fan and a riffle box in a coal fine delivery system, the exhauster fan having a first axis of rotation, a discharge valve plate rotatable between an open position and a closed position blocking the conduit, the improvement comprising the orientation of the valve plate on a second axis of rotation generally perpendicular to the first axis of rotation such that the valve plate generally bisects the conduit to define upper and lower flows of coal fines, the upper and lower flows of coal fines each having heavy and light flow distributions across the width of the conduit, the improvement further comprising a plurality of ring-like diffuser elements extending from the valve plate into the upper and lower flows, the diffuser elements having portions in both the heavy and light flow distributions to cause the heavy and light flow distributions to mix prior to reaching the riffle box.

* * * * *